United States Patent [19]

Armstrong et al.

[11] 4,220,526

[45] Sep. 2, 1980

[54] SIZING SCREENS AND FEEDER DEVICES THEREFOR

[75] Inventors: Michael P. Armstrong, Etwall; Rodney W. O'Brian, Swadlincote, nr. Burton-on-Trent, both of England

[73] Assignee: Coal Industry (Patents) Limited, London, England

[21] Appl. No.: 945,864

[22] Filed: Sep. 26, 1978

[30] Foreign Application Priority Data

Oct. 10, 1977 [GB] United Kingdom ..... 42012/77

[51] Int. Cl.[2] ..... B07B 1/08

[52] U.S. Cl. ..... 209/240; 209/254; 209/264; 209/279; 209/350

[58] Field of Search ..... 209/146–149, 209/151, 240, 243–245, 247, 254, 261, 279, 263–264, 324, 350; 55/418; 222/408; 193/2 R; 432/58

[56] References Cited

U.S. PATENT DOCUMENTS

| | | | |
|---|---|---|---|
| 746,410 | 12/1903 | Turner | 222/408 |
| 1,296,926 | 3/1919 | Cox | 209/151 |
| 2,804,309 | 8/1957 | Sweet | 222/408 |

FOREIGN PATENT DOCUMENTS

| | | |
|---|---|---|
| 369748 | 3/1932 | United Kingdom . |
| 740126 | 11/1955 | United Kingdom . |
| 1190174 | 4/1970 | United Kingdom . |
| 1307290 | 1/1973 | United Kingdom . |

*Primary Examiner*—Richard L. Chiesa

*Attorney, Agent, or Firm*—Stevens, Davis, Miller & Mosher

[57] ABSTRACT

A sizing screen provided with feeder means for causing an even distribution of material onto the screen surface. The feeder means comprises a generally spirally shaped plough which urges material over the edge of a generally circular table the distribution of material being substantially uniform over the edge. The plough has a compaction zone for compacting the material so that urging forces exerted by the plough are not absorbed in the material. A chute which can be stepped feeds material onto the table through the plough.

6 Claims, 8 Drawing Figures

IV
IV
III
6
4
16
13
22
22
17
V
V
58
57
62
61
60
59
37
39
III 4
3
13
22
22
VI
VI
49
50
46
17
48
52
15
53
53
15
VII
VII
27
25
14
45
34
5
30
32
25
26
27
8
8
26
29
38
43
29
36
40
35
24
21
55

SIZING SCREENS AND FEEDER DEVICES THEREFOR

This invention relates to sizing screens for particulate material of different sizes and to feeder devices therefor.

In particular, though not exclusively, the invention relates to sizing screens for screening moist, small size particles, e.g. less than twenty-five millimeters. The invention is particularly, though not exclusively useful, in treating sticky material such as moist raw coal containing clay.

A known type of sizing screen is shown in the assignees British Pat. No. 1,307,290. An object of the present invention is to provide an improved sizing screen.

According to one aspect of the present invention a sizing screen for particulate material of different sizes comprises a circular screen surface having a plurality of elongate radially projecting members, drive means for rotating the screen surface, first collection means positioned adjacent to the outer periphery of the surface for collecting an oversize fraction of the particulate material, second collection means positioned below the surface for collecting an undersize fraction of the particulate material and feeder means for feeding the particulate material onto the screen surface, the feeder means being provided with a generally spirally shaped plough.

Preferably, the feeder means comprises a rotatable table positioned below the plough and rotatable with respect thereto the table moving the material with respect to the plough.

Advantageously, the plough includes a compacting zone for compacting the particulate material.

Consequently, the feeder means comprises a stepped chute for feeding the particulate material onto the plough.

The radially projecting members are drive fitted into a hub.

The radially projecting members preferably comprise metal rods.

According to another aspect of the present invention a feeder means for feeding particulate material onto a sizing screen comprises a chute for evenly distributing particulate material from the mouth thereof, a generally spirally shaped plough situated under the mouth of the chute and a table situated under the plough and rotatable with respect thereto, the table being arranged to cause relative movement between the particulate material and the plough.

Preferably, the plough includes a compacting zone.

A drive means effects relative rotation between the table and the plough.

An embodiment of the present invention will now be described by way of example only, with reference to the accompanying drawings in which.

Figure 1:
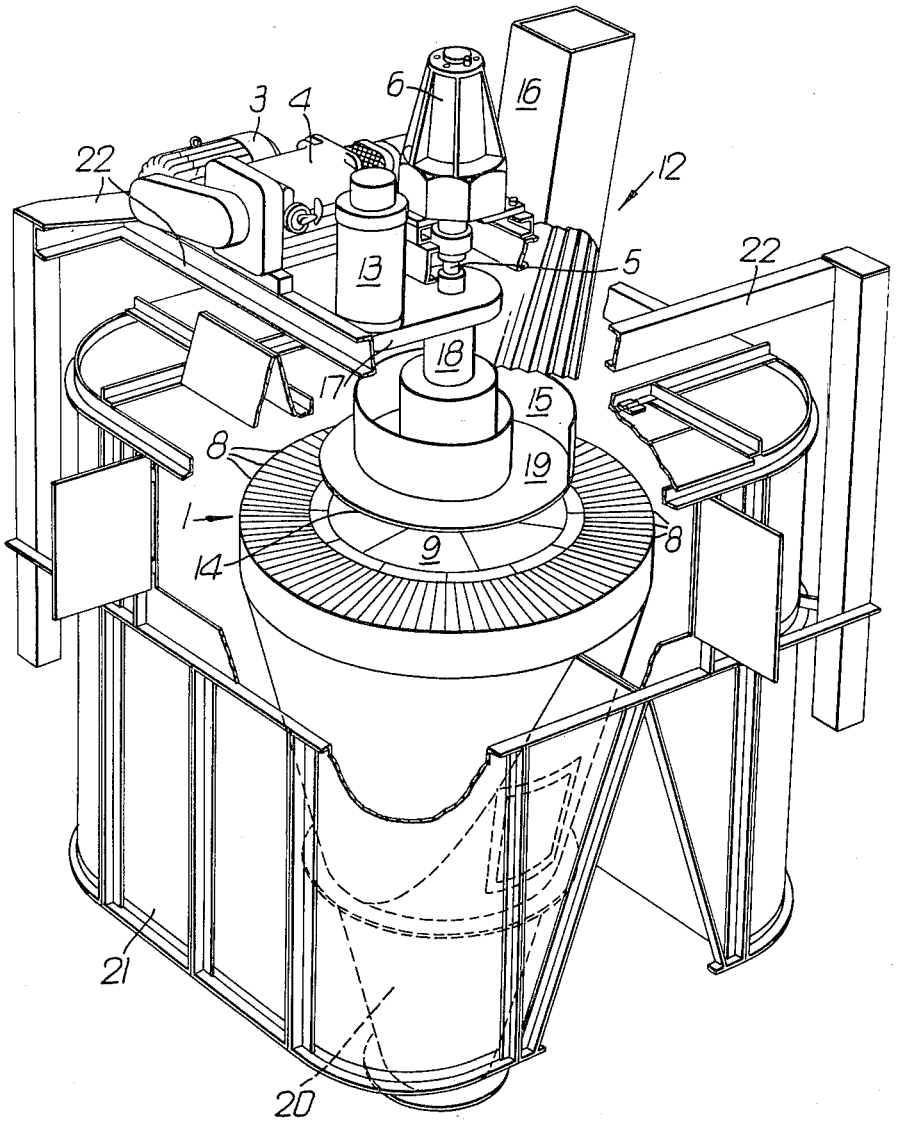
FIG. 1 is an incomplete perspective view.

Referring to FIG. 1 a sizing screen can be seen to comprise a circular screen surface 1. The screen surface 1 is rotatably mounted and is drivably connected to a motor 3 via a gearbox 4 and a vertically disposed drive shaft 5 (not all of which can be seen in FIG. 1, but which is shown fully in FIG. 3) mounted in a bearing 6. The screen surface comprises a plurality of radially disposed metal rods 8 and a hub assembly (not shown in FIG. 1). The screen surface is described more fully below.

Particulate material is fed onto the screen surface by feeder means generally indicated at 12. The feeder means 12 comprises a rotatable feed table 14, a fixed generally spiral plough 15 and a stepped feed chute 16. The rotatable table 14 is drivably connected to a motor 13 via a roller chain linkage 17 and a driven cylinder 18, which cylinder is secured to the table 14. The table 14 rotates about the same vertical axis as the screen surface 1. The outermost boundary of the plough 15 overlaps an innermost boundary thereof around at least a part of the circumference of the table 14 to form a compacting zone 19 which is referred to below wherein the inner and outer walls of the plough overlap.

A generally conical hopper 20 is positioned below the screen surface 1 and collects undersize particles of material that pass therethrough. A further, partly shown hopper 21 sleeves the hopper 20 and oversize material which cannot pass through the screen surface 1 is collected in said hopper 21. The hoppers 20, 21 have respective outlet means (not shown in FIG. 1) to facilitate removal of undersize and oversize material, respectively.

An incompletely shown supportive framework for the sizing screen is indicated variously at 22.

The sizing apparatus is further described in more detail with reference to the remaining FIGS. 2–8, the same reference numerals being used insofar as is appropriate.

Figure 2:
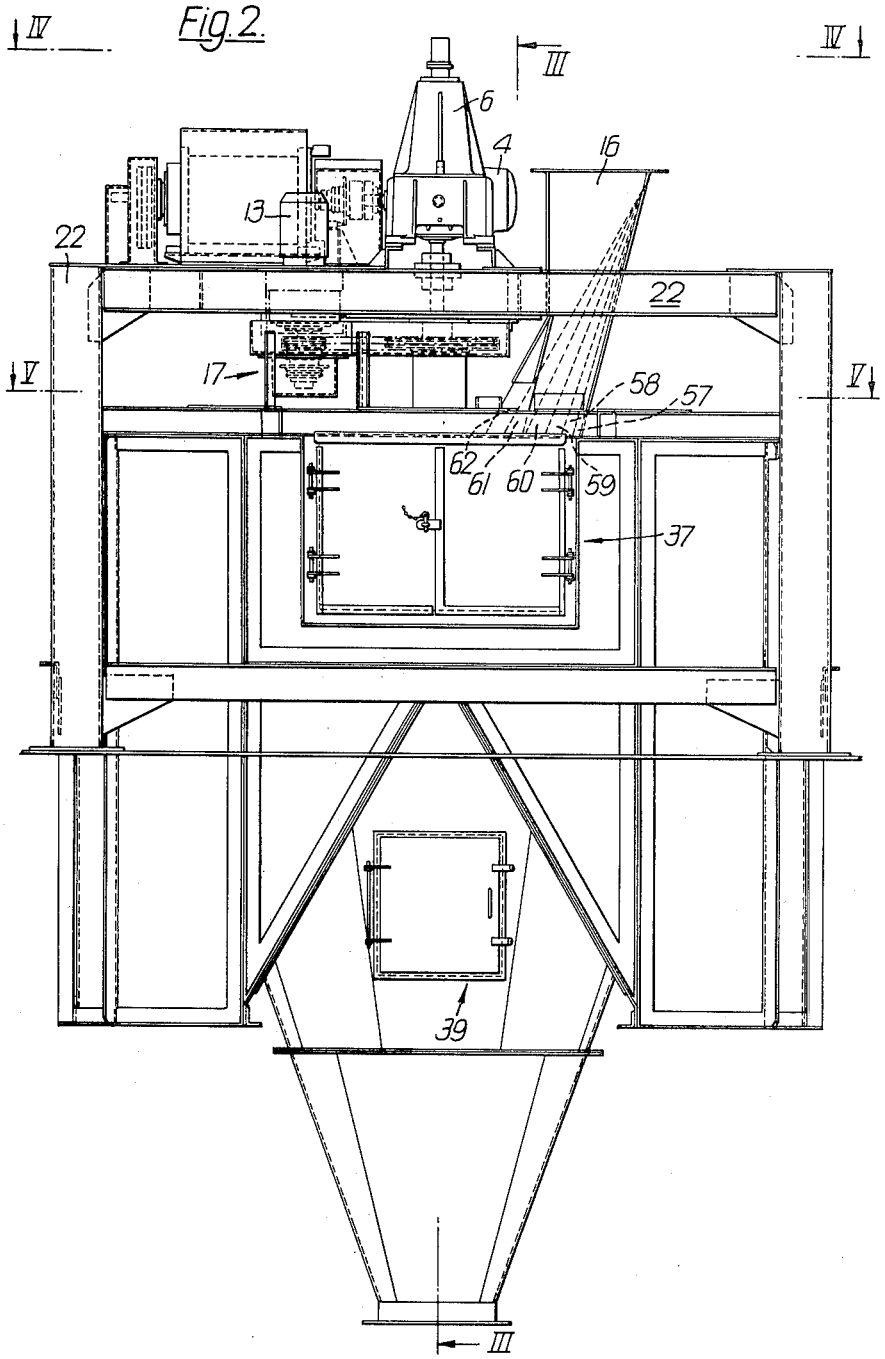
FIG. 2 is a side view.
Figure 3:
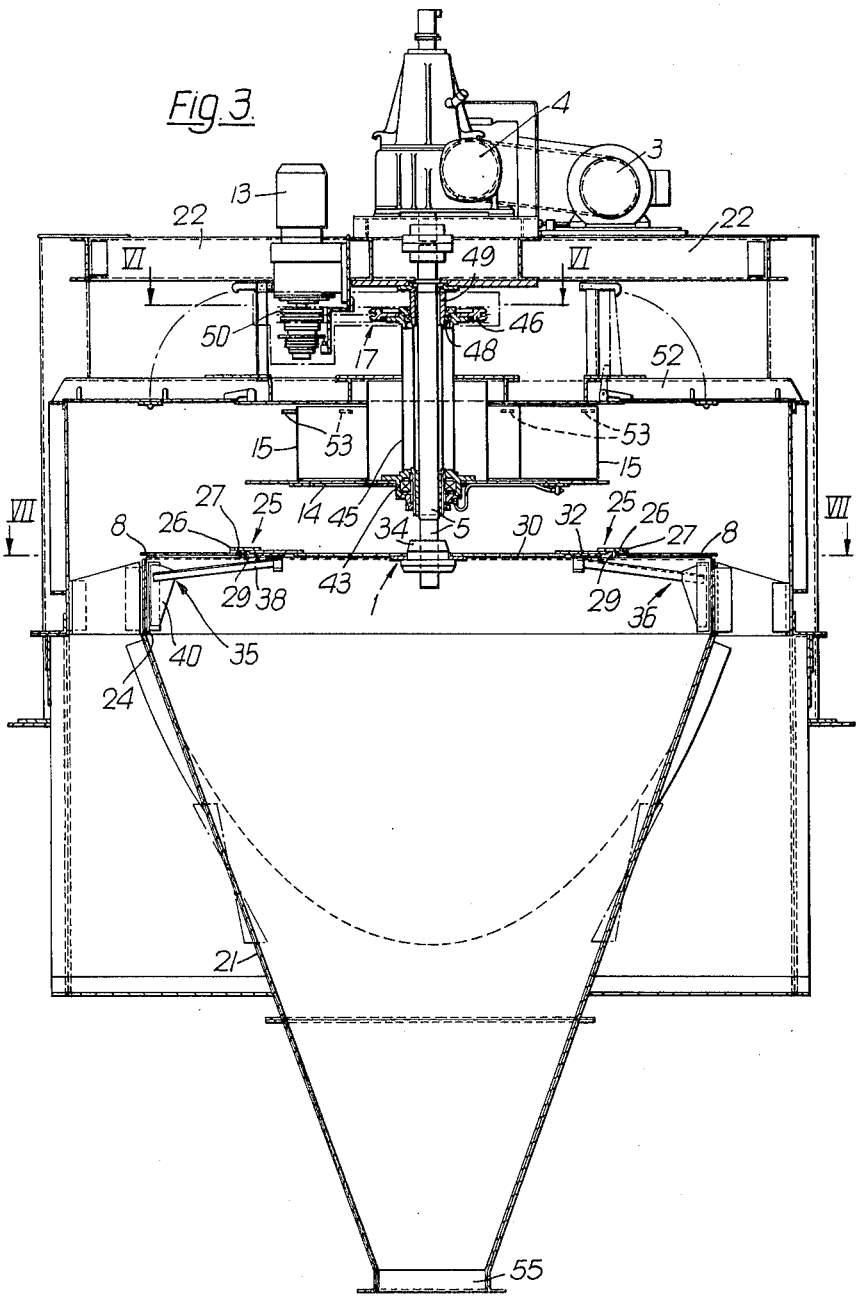
FIG. 3 is a sectional view looking along III—III in FIG. 2.

Reference is now made to FIGS. 2 and 3.

The screen deck 1 comprises the elongate metal rods 8, and is secured to an annular ring 25. The annular ring 25 comprises a plurality of segments 26 only two of which are shown in FIG. 3.

The ring 25 is secured to a hub plate 30 by a segmented annular extension plate 32. The hub plate 30 is secured to a hub boss 34 which in turn is attached to the shaft 5. Scraper devices 35 and 36 are mounted below the extension plate 32 and each scraper device comprises a pivotally mounted lever 38 and a scraper paddle 40. The attachment of the rods 8 to the ring 25 is shown in detail and described below with reference to FIG. 8, but in FIG. 3 a composite material block 27 can be seen attached to each of the segments 26. A plurality of holes is moulded or drilled into the blocks 27, each hole providing a respective drive fitting for one of the metal rods 8. The rods 8 abut a backstop comprising a circular vane 29.

In FIG. 2, the feed means 12 may be seen to comprise the stepped chute 16, in which separate stepped feeds in the chute are shown by dotted lines 57, 58, 59, 60, 61 and 62. The chute 16 feeds material onto the table 14 via the plough 15, see FIG. 3. The table 14 is supported by a hub 43 which is rotatably mounted on a bearing 44. The hub 43 is fixedly attached to a cylinder 45. A gear wheel 46 is fixedly attached to the cylinder 45 away from the bearing 44. The gear wheel 46 is rotatably mounted on a bearing 48 on a sleeve 49 which sleeves the drive shaft 5. The gear wheel 46 is engageable by a roller chain (not shown in FIG. 3) and when engaged transmits drive through the cylinder to the table 14, which latter is rotated thereby. The roller chain is driven by a drive pinion 50 secured to the motor 13.

Figure 5:
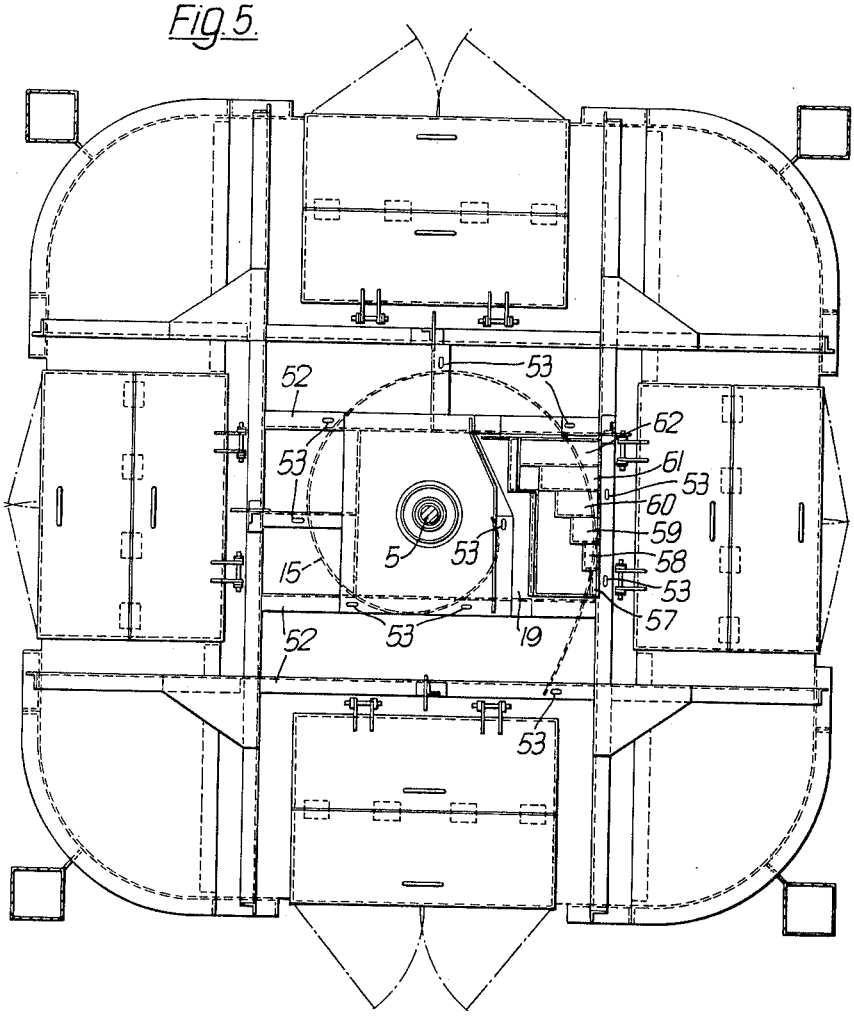
FIG. 5 is a sectional view looking along V—V in FIG. 2.

The plough 15 is supported by attachment to a framework 52, which is best seen in FIGS. 3 and 5. The plough is attached by a plurality of slide attachments 53 in order that it may be adjusted in position. The slide attachments 53 (not shown in detail) comprise bolts on the plough 15 which engage in slots in the framework 52.

The hopper 20 comprises a generally conical part 71 and an annular part 24. The annular part is swept by the scraper device 35 and 36 as the screen deck 1 rotates. Outlet means 55 are provided from the hopper to allow egress of undersize particles.

Access doors are shown at 37 and 39, respectively.

Figure 4:
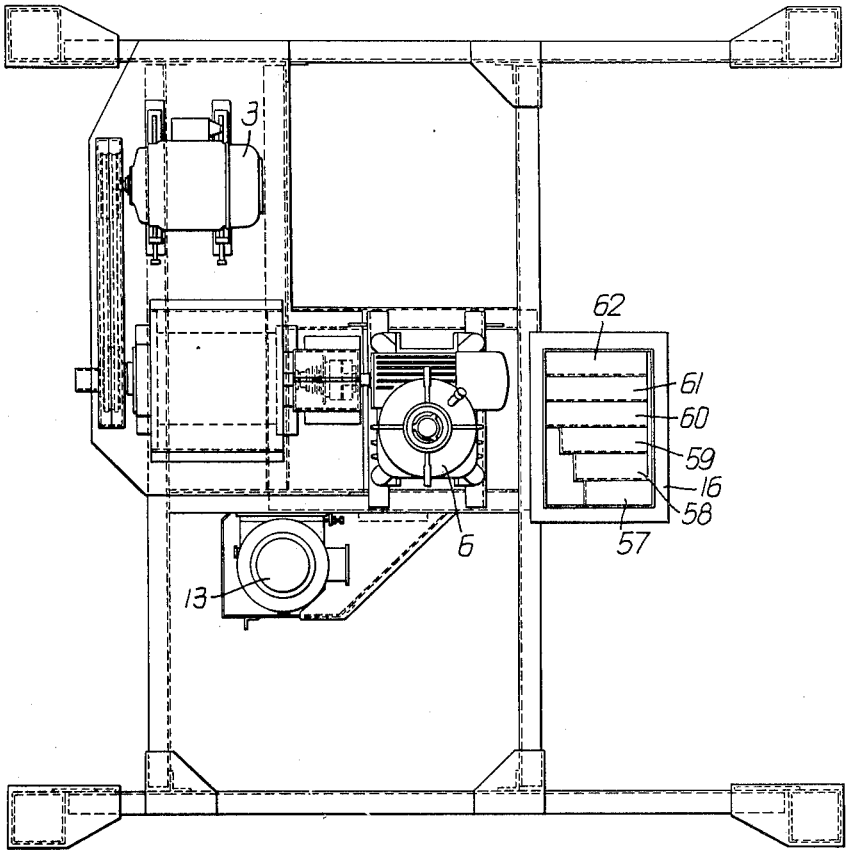
FIG. 4 is a plan view looking along IV—IV in FIG. 2.

Referring now to FIG. 4, the six separate stepped feeds 57, 58, 59, 60, 61 and 62 in the chute 16 are more clearly shown. The six feeds ensure that material fed through the chute is evenly distributed on the table 14 as separately, they extend over separate areas of the mouth of the chute 16, but together they extend over the entire mouth area. The mouth area is defined by the walls of the chute between which material can fall.

Turning to FIG. 5, the framework 52 and the slide attachments 53 can be clearly seen. The spiral-like configuration of the plough 15 is shown dotted. The relative positions of the separate feeds 57 to 62 are also shown. In the Figure, it can be seen that the compaction zone 19 is provided underneath the feed chute 16 by the extreme ends of the plough 15. In operation described more fully below the table 14 rotates in a clockwise direction so as to urge material which has been fed through the chute 16 into the compaction zone 19.

Figure 6:
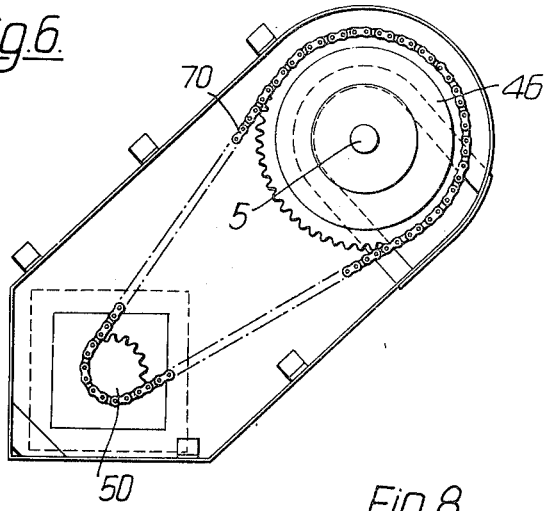
FIG. 6 is an incomplete sectional view looking along VI—VI of FIG. 3.

FIG. 6 shows the roller chain referred to above, which is designated by 70.

Figure 7:
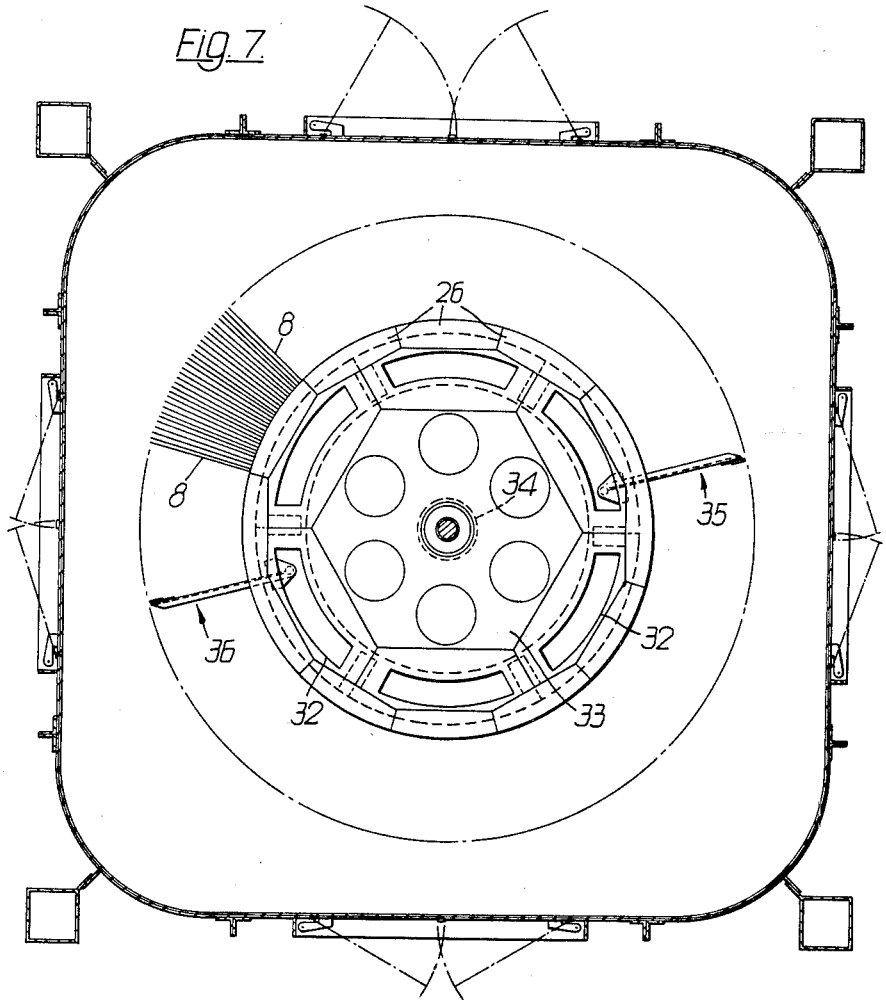
FIG. 7 is an incomplete secional view looking along VII—VII of FIG. 3.

FIG. 7 shows the screen surface 1 in part and the metal rods are again indicated at 8. The annular ring 25 comprises twelve segments 26 for supporting the elongate metal rods 8 and six segments of the annular extension plate 32. The annular extension plate is secured to the hub plate 30 which in turn is attached to the central hub boss 34. The annular extension plate 32 is provided so that the screen surface can be easily dismantled and removed from below for overhaul and servicing work.

Figure 8:
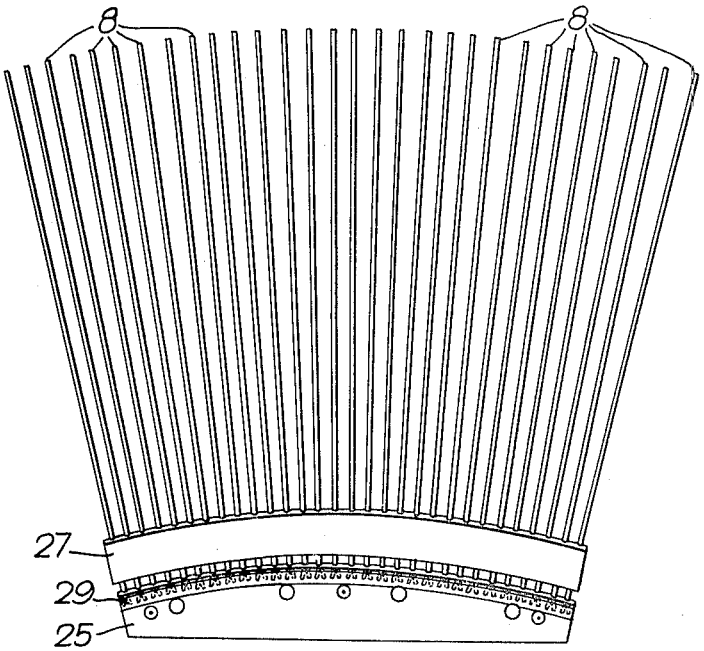
FIG. 8 is a plan view of part of FIG. 7 showing more detail.

Attachment of the elongate metal rods 8 to a segment of the annular ring 25 is shown in more detail in FIG. 8. The elongate metal rods are split and the ends of the rods protruding inside the composite material 27 are splayed out. Consequently, the elongate metal rods are securely retained by their drive fitting in the composite material and by their splaying.

In operation, the screen surface is rotated at a variety of speeds dependent upon the size at which the material is to be screened. It will be appreciated that increasing the speed of the screen surface effectively narrows the aperture through which particles of material may fall i.e. increasing the speed increases the probability that particles will be struck by one or more of the elongate metal rods 8. In this way, the rotation speed defining the effective aperture size, the screen surface 1 selects the size of particles of material which are allowed passage through the screen surface.

Undersize material passes through the screen surface 1 and into the hopper 20 and therefrom through the outlet means 55. Oversize material is urged by centrifugal force towards the outer edge of the screen surface and falls into the hopper 21. The elongate metal rods 8 do not have support means at their outer radial ends and for this reason no obstruction is offered to the oversize particles in their path towards the hopper 21.

The scraper devices 35 and 36 scrape the inside of the hopper 20 so that a blocking build up of undersize material does not form on the annular part 24 of the wall of the hopper.

The scraper devices can pivot about 15° in a horizontal plane so that they are not knocked off by material scraped from the inside wall of the hopper 20.

Operation of the feed means 12 is as follows. Material arrives at the sizing screen by way of the stepped feed chute 16. The chute is stepped over the table 14 and the plough 15 such that material is distributed evenly from the mouth of the feed chute rather than in a conical pile. The material falls under gravity from the top to the bottom of the feed chute and strikes the steps in the chute so far as its path is obstructed by them. As best shown in FIGS. 1 and 2, the steps extend different distances towards the center of the table so that material will be moved towards the center of the table dependent upon the steps it strikes. The material falls through the plough 15 and is then urged into the compaction zone 19 by rotation of the table 14. The material is then compacted by co-action of the relatively inner and relatively outer walls of the plough. Such compaction is desirable in operation, since otherwise the material may be able to absorb urging forces imparted by the plough without moving as a whole relative to the plough. The table 14 continues to rotate (in a clockwise direction) so that material is moved as a whole and gradually urged over the side of the table 14 by the plough 15 which owing to its generally spiral shape gradually approaches the side of the table. The material is thus urged uniformly over the edge of the table around the circumference thereof to provide a uniform feed onto the screen surface 1.

The screen surface 1 and the table 14 are driven as described previously by the motors 3 and 13 respectively. The screen surface and table can be driven at a variety of different speeds and can be contra-rotated if the desired screening size is such that contra-rotation affords the size.

In some other embodiments of the invention the screen surface is adjustable in inclination and can be inclined at different and more suitable angles to the horizontal.

In further embodiments of the invention, the sizing screen comprises more than one screen surface.

We claim:

1. A sizing screen for particulate material of different sizes comprising a circular screen surface having a plurality of elongate radially projecting rod members, drive means for rotating the screen surface, first collection means positioned adjacent to the outer periphery of the screen surface for collecting an oversize fraction of the particulate material, second collection means positioned below the screen surface for collecting an undersize fraction of the particulate material and feeder means for feeding the particulate material onto the screen surface, the feeder means comprising a particulate material dispersing chute, a generally continuously spirally shaped stationary plough positioned below the chute, and a rotatable table onto which material is fed from the chute and which is positioned below the plough and which is rotatable with respect thereto, the table moving the material with respect to the plough such that the particulate material moving on the table is pushed by the plough uniformly over the edge of the rotating table substantially around the whole table circumference to provide a uniform feed of said particulate material onto the circular screen surface.

2. A sizing screen as claimed in claim 1, wherein the plough includes a compacting zone for compacting the particulate material, the compacting zone being defined between a relatively inner and a relatively outer wall of the plough which can co-act on the material.

3. A sizing screen as claimed in claim 2, wherein said particulate material dispensing chute is a stepped chute positioned above the plough for feeding the particulate material through the plough and onto the table.

4. A sizing screen as claimed in claim 1, wherein the radially projecting members are drive fitted into a hub.

5. A sizing screen as claimed in claim 4, wherein the radially projecting members comprise metal rods.

6. A sizing screen as claimed in claim 5 wherein the rods have splayed out ends within the hub.

* * * * *